United States Patent [19]

Eheim

[11] 4,345,563

[45] Aug. 24, 1982

[54] FUEL INJECTION PUMP FOR INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 163,117

[22] Filed: Jun. 26, 1980

[30] Foreign Application Priority Data

Jul. 19, 1979 [DE] Fed. Rep. of Germany ..... 2929176

[51] Int. Cl.[3] ..... F02M 59/20

[52] U.S. Cl. ..... 123/458; 123/357; 123/459; 123/502

[58] Field of Search ..... 123/357, 501, 502, 458, 123/459, 503, 506

[56] References Cited

U.S. PATENT DOCUMENTS

| | | | |
|---|---|---|---|
| 3,234,927 | 2/1966 | Cramer, Jr. | 123/367 |
| 3,661,130 | 5/1972 | Eheim | 123/506 |
| 3,699,939 | 10/1972 | Eckert et al. | 123/459 |
| 4,168,690 | 9/1979 | Höfer | 123/502 |

*Primary Examiner*—Charles J. Myhre
*Assistant Examiner*—Andrew M. Dolinar
*Attorney, Agent, or Firm*—Edwin E. Greigg

[57] ABSTRACT

A fuel injection pump for internal combustion engines is proposed wherein the pressure of a supply pump is controlled in accordance with rpm. A valve which controls the pressure additionally in accordance with load is actuated via a member, actuated in accordance with load, of the rpm governor of the pump. The preferred embodiment relates to distributor-type injection pumps having an electric final control element, the rotary shaft of which acts as the movable member of a slide valve.

6 Claims, 1 Drawing Figure

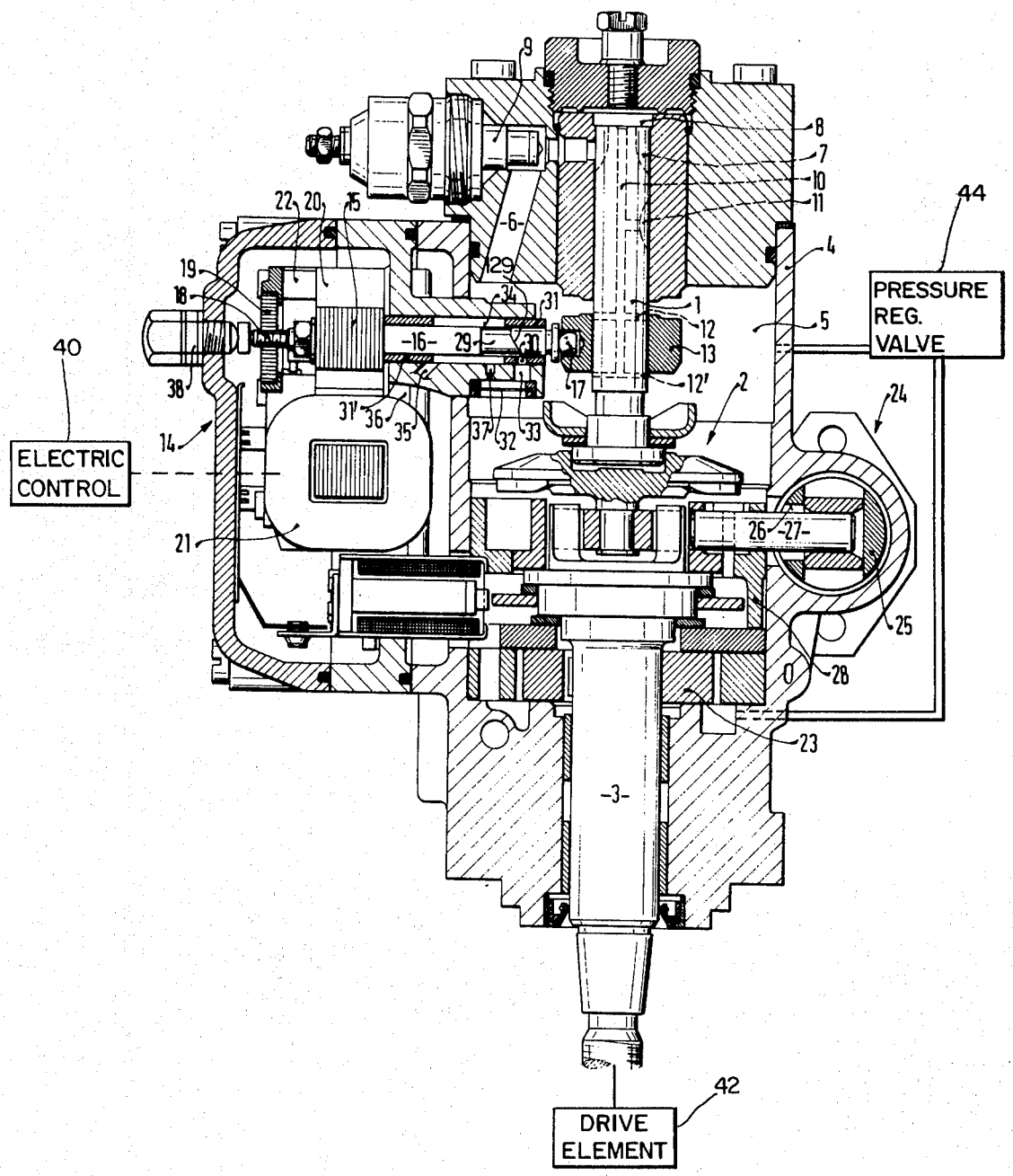
PRESSURE REG. VALVE
ELECTRIC CONTROL
DRIVE ELEMENT
40
42
44

FUEL INJECTION PUMP FOR INTERNAL COMBUSTION ENGINES

BACKGROUND OF THE INVENTION

The invention relates to a fuel injection pump for internal combustion engine having a supply pump which is controlled by a pressure control valve and is also controlled to generate an rpm-dependent pressure. An adjusting member of an rpm governor is also provided for additionally varying the pressure in accordance with load. In a known fuel injection pump of this kind, the load-dependent change in the pressure is attained via an adjusting sleeve of the centrifugal rpm governor, which, however, only indirectly engages a governor lever which actuates the quantity control member of the pump. The pressure thus corresponds to the injection quantity only when the adjusting sleeve and the governor lever are in direct, force-locking communication and furthermore when no additional control members are disposed between the two, such as adaptation springs and the like. In a different, known fuel injection pump, the change in pressure is effected by means of a pressure control valve engaged by an adjusting magnet. In the specialized instance, the adjusting magnet engages the pressure control valve spring on the side remote from the control slide and varies the initial stressing of the spring in a load-dependent manner.

In still another different known fuel injection pump, the pressure is controlled in accordance with temperature by permitting the discharge of partial quantities of fuel. However, it has also already been suggested that the pressure be additionally controlled via magnetic valves which control the flow of a quantity of fuel either in or out. In all the known systems, the supplemental or redundant pressure control serves the purpose of varying the injection onset, because the supply pump pressure is exerted upon a piston whose purpose is injection onset adjustment. These known supplemental control means are relatively expensive and require additional independent means, such as a specialized closed control loop.

OBJECT AND SUMMARY OF THE INVENTION

The fuel injection pump according to the invention has an adjusting member which directly engages a fuel quantity control member of the fuel injection pump, so that pump pressure always corresponds to the injection quantity. Thus, the present invention has the advantage over the prior art in that already existing means functioning in accordance with load, that is, means into which the load variable has already been fed, are used for the purpose of pressure control and the pressure directly corresponds to the injection quantity. It is possible to omit a separate closed control loop, as well as substantial costs for transformers and transducers.

The invention will be better understood and further objects and advantages thereof will become more apparent from the ensuing detailed description of a preferred embodiment taken in conjunction with the drawing.

BRIEF DESCRIPTION OF THE DRAWING

One exemplary embodiment of the subject of the invention is shown in the drawing and described in detail below.

DESCRIPTION OF THE PREFERRED EMBODIMENTS

As is indicated in FIG. 1, a pump piston 1 is actuated by a cam drive 2 and a drive shaft 3 into a simultaneously reciprocating and rotating motion by a drive element 42 (e.g., motor). From a suction chamber 5 provided in the housing 4 of the pump, a pump work chamber 8 is supplied with fuel during the return stroke of the pump piston 1 via a suction duct 6 and longitudinal grooves 7 disposed in the surface of the piston 1. The suction duct 6 is controlled by a magnetic valve 9, which closes the suction duct 6 in case the electrical power fails. The mangetic valve 9 is thus closed in the absence of electric power and is shown in FIG. 1 in the work position. During the compression stroke of the pump piston 1, the fuel enters a distribution groove 11 via a central bore 10 and the distribution groove 11 opens each of the pressure ducts leading to the internal combustion engine, one after another, once per compression stroke.

The central bore 10 has a cross bore 12, which after a certain stroke distance has been covered, emerges from a ring slide 13 and so produces a connection between the pump work chamber 8 and the suction chamber 5, by which means the injection is ended. The reverse is, however, also conceivable; that is, the injection first begins, as alternatively depicted with a cross bore 12', when this cross bore 12' makes a pressure build-up in the pump work chamber 8 possible by entering into the ring slide 13 and so makes possible the initiation of injection. In the first case, the quantity control is attained by controlling the end of injection; in the second case, it is attained by controlling the initiation of injection.

The ring slide 13 is displaceable by a rotary magnet 14 (which functions as an rpm governing device), by which means the amount of fuel to be injected at a particular time varies. The armature 15 of the rotary magnet is coupled with the ring slide 13 via a shaft 16 supported in the housing 4 and a driver crank 17 disposed eccentrically on the end face of this shaft, so that a rotation of the armature 15, or of the shaft 16 results in a displacement of the ring slide 13. A spiral-shaped return spring 19 engages the end 18 of the shaft 16. The rotary magnet 14 further has a U-shaped core 20 as well as a coil 21 which is disposed in the base of the U as is shown in FIG. 2. The gap between the armature 15 and the arms 22 at the end of the shanks of the core 20 is conically shaped for the purpose of linearization of the adjustment forces. Naturally this gap can also be parallel and the return spring 19 can be any desired kind of spring engaging an appropriate lever. Rotary magnet 14 is controlled by electric control 40, controlled in response to engine operating parameters.

The rotation of the armature 15 is measured by an inductive transducer, which is disposed, but no visible, in the illustrated embodiment, next to the coil 21. In this way, the adjacent cavity that results because of the diameter of the coil 21 is advantageously used, in that the transducer can be secured directly to the core 20.

A supply pump 23 which pumps into the suction chamber 5 of the fuel injection pump is also driven by the drive shaft 3 of the injection pump. The pressure in this suction chamber 5 is determined by a pressure control valve, 44 (similar to that shown in U.S. Pat. No. 3,358,662) which controls the pressure in accordance with rpm; that is, as the rpm increase, so does the pressure. This pressure variation is used especially for controlling the onset of injection, to which end there is a device 24 having an adjusting piston 25 exposed to this pressure. This adjusting piston 25 is displaced counter to a restoring spring by the pressure in the suction chamber 5, this pressure reaching the adjusting piston 25 by way of a connection 26. By means of the adjusting piston 25, the roller ring 28 of the cam drive 2 is adjusted via a bolt 27, thus adjusting the onset of injection.

In order to be able to change the pressure in the suction chamber 5 in accordance with load—in the present case, primarily for the sake of the injection onset—the shaft 16 additionally acts as the slide element of a valve. To this end, an annular groove 29 is provided in the jacket of the shaft 16 and has an oblique control edge 129 which controls a bore 30 disposed between two sleeves 31 and 31' which receive the shaft 16. The fuel proceeds out of the suction chamber 5 via a filter 32 and a bore 33 provided in the housing to the bore 30, and from there is directed via the oblique control edge into the annular groove 29, then via the annular chamber 34 disposed between the sleeves 31 and 31' and an oblique bore 35 disposed in the housing to the suction side of the supply pump or into the pressure-relieved chamber 36, in which the rotary magnet 14 is disposed. In addition to the controlled bore 30, there is a throttle bore 37, which is always open, acting as a connection between chambers 5 and 36.

The function of this load-dependent control is as follows: At full load and in the starting position of the fuel quantity final control element 14, the bore 30 is covered by the shaft 16. During the shutoff or downward control process, however, the shaft 16 rotates and thus gradually opens the control bore 30, so that as a result of this control location a predetermined volume of fuel can flow out of the suction chamber 5 of the injection pump and into the chamber 36 of the final control element 14. The pressure in the suction chamber 5 drops accordingly as a result. Because this pressure in the suction chamber 5 also engages the hydraulic injection instant adjuster 24, this pressure drop causes a displacement of the injection instant toward "late", specifically when the engine is under partial load.

The quantity of fuel flowing through the constant throttle 37 from the suction chamber 5 into the chamber 36 effects a certain cooling of the final control element 14.

The shaft 16, because of the higher pressure prevailing in the suction chamber 5 than in chamber 36, is displaced toward the final control element 14 against a stop screw 38, as a result of which adjustment, or orientation of the oblique control edge of the groove 29 relative to the control bore 30, is possible. The stop screw 38 can be a supplementary item of equipment, since it is not a prerequisite for the functioning of the invention.

Instead of a valve of the type shown in the drawing, it is also conceivable for an annular slide disposed about the shaft to act as a valve, the annular slide being adjustable, especially for the purpose of adjustment, and having the appropriate channels for the required discharge of fuel.

The invention is not restricted to the exemplary embodiment; instead, it can also be realized in other pump types in which an adjusting member of the rpm governor can be used for the purpose of controlling a valve with the aid of which the pressure is variable in load-dependent fashion.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection pump assembly for internal combustion engines, comprising: a fuel injection pump; a fuel supply pump; means for driving both pumps in synchronism; a housing defining a suction chamber into which fuel is delivered by the fuel supply pump; a pressure control valve connected to the suction chamber for controlling the pressure of the fuel in the suction chamber as a function of engine rpm; a fuel quantity adjustment member; and an rpm governor connected to the fuel quantity adjustment member for adjustment of the fuel quantity adjustment member, the improvement in the rpm governor, comprising:

a pressure relief chamber;

a fuel connecting line connecting the pressure relief chamber to the suction chamber;

a rotatably mounted shaft; and guide means surrounding said rotatably mounted shaft; wherein:

(i) the rotatably mounted shaft includes an eccentric end portion which directly engages the fuel quantity adjustment member and controls the adjustment thereof;

(ii) the rotatably mounted shaft defines first means and the guide means defines second means; and (iii) both said first means and said second means cooperate to form a valve controlling the extent of opening of the fuel connecting line as a function of the rotation of said rotatably mounted shaft.

2. In the fuel injection pump assembly as defined in claim 1, wherein the second means comprises a bore in said guide means, and wherein the first means comprises an annular groove and an obliquely oriented edge, the annular groove being in continuous communication with one side of the fuel connecting line and the obliquely oriented edge controlling the opening of the bore in said guide means.

3. In the fuel injection pump assembly as defined in claim 2, wherein the assembly further comprises: an injection onset control device in communication with the suction chamber, and wherein the annular groove and obliquely oriented edge define said valve.

4. In the fuel injection pump assembly as defined in claim 3, wherein the improvement further comprises:

a throttle bore, and wherein the rpm governor is disposed within the pressure relief chamber, said rpm governor being cooled by fuel flowing through said throttle bore.

5. In the fuel injection pump assembly as defined in claim 4, wherein the improvement further comprises:

a stop adjustable coaxially with respect to said rotatably mounted shaft wherein the fuel quantity adjustment member is disposed within the suction chamber, and wherein the end of the rotatably mounted shaft opposite to said eccentric end portion is urged against the stop by pressure in the suction chamber.

6. In the fuel injection pump assembly as defined in claim 1, wherein the improvement further comprises:

means for generating electric control signal, wherein the rpm governor includes an electromagnetically actuatable servomotor which is controlled by electrical signals generated by said means for generating an electric control signal.

* * * * *